US005108319A

United States Patent [19]

Tsuji et al.

[11] Patent Number: 5,108,319

[45] Date of Patent: Apr. 28, 1992

[54] CONNECTOR WITH A TERMINAL LOCKING DEVICE

[75] Inventors: Masanori Tsuji; Motohisa Kashiyama, both of Shizuoka, Japan

[73] Assignee: Yazaki Corporation, Tokyo, Japan

[21] Appl. No.: 774,487

[22] Filed: Oct. 10, 1991

[30] Foreign Application Priority Data

Oct. 12, 1990 [JP] Japan ..... 2-272367

[51] Int. Cl.[5] ..... H01R 13/436

[52] U.S. Cl. ..... 439/752; 439/595

[58] Field of Search ..... 439/595, 752

[56] References Cited

U.S. PATENT DOCUMENTS

| | | | |
|---|---|---|---|
| 4,045,110 | 8/1977 | Sterken | 339/91 |
| 4,343,523 | 8/1982 | Cairns et al. | 339/59 |
| 4,544,220 | 10/1985 | Aiello et al. | 339/59 |
| 4,583,805 | 4/1986 | Mantlik | 339/61 |
| 4,602,839 | 7/1986 | Winger | 339/91 |
| 4,655,525 | 4/1987 | Hunt, III et al. | 339/63 |
| 4,758,182 | 7/1988 | Anbo et al. | 439/592 |
| 4,946,398 | 8/1990 | Takenouchi et al. | 439/752 |
| 5,037,336 | 8/1991 | Betsui | 439/752 |

FOREIGN PATENT DOCUMENTS

| | | |
|---|---|---|
| 0079120 | 5/1983 | European Pat. Off. . |
| 60-249273 | 12/1985 | Japan . |
| 63-58470 | 4/1988 | Japan . |

*Primary Examiner*—Gary F. Paumen

*Attorney, Agent, or Firm*—Armstrong, Nikaido, Marmelstein, Kubovcik & Murray

[57] ABSTRACT

The connector housing has a terminal accommodating chamber block made up of a plurality of terminal accommodating chambers that are separated from each other by walls and that open in directions crossing the axial direction of the block. The terminal locking device fitted over the terminal accommodating chamber block is advanced in two steps, first into a preliminary-engagement state and then into a full-engagement state with respect to the connector housing. The terminal locking device has resilient deflecting plates which have terminal locking projections formed on the inner side thereof that protrude through the openings into the terminal accommodating chambers. In the preliminary-engagement state, the resilient deflecting plates ride on tapered projections formed on the outer wall surfaces of the terminal accommodating chamber block, holding the terminal locking projections out of a terminal lug insertion path in the terminal accommodating chambers. This allows the terminal lug to be pulled out easily from the connector.

1 Claim, 4 Drawing Sheets

CONNECTOR WITH A TERMINAL LOCKING DEVICE

BACKGROUND OF THE INVENTION

1. Field of the Invention

The present invention relates to a connector used for connecting wiring harnesses in automobiles and more particularly to a connector which has a terminal locking device at the rear.

2. Description of the Prior Art

In FIG. 7, denoted a is a connector housing and b a terminal locking device. The terminal locking device b is in a preliminary-connected condition in which its housing engagement arm c is engaged with a preliminary-connection projection d. From this state, the terminal locking device b is further pushed to a full-connection state in which the housing engagement arm c is engaged with a full-connection projection e. (Japanese Patent Preliminary Publication No. Showa 63-58470.)

FIG. 8 is a cross section of the connector housing and the terminal locking device in a preliminary-connection state. The terminal locking device b has a resilient terminal locking piece f. The resilient terminal locking piece f has at its free end a bulged portion $f_1$, which is located in each terminal accommodating chamber g. A terminal lug h connected with a wire w is inserted from the rear into the terminal accommodating chamber g, pushing up the bulged portion $f_1$ through a window $a_1$ in the connector housing a until the terminal lug h engages with a resilient locking piece i. Then, the terminal locking device b is moved to the full-connection state to position the bulged portion $f_1$ of the terminal locking piece f immediately behind the back of an electrical contact portion $h_1$ of the terminal lug h. Now, the terminal lug h is doubly locked (FIG. 9).

As to an incompletely inserted terminal lug h, when the terminal locking device b is moved to the full-connection state, the bulged portion $f_1$ of the terminal locking piece f abuts against the terminal lug h, pushing it to the normal position where it engages with the resilient locking piece i (FIG. 10).

With this locking technique, however, when one wants to remove the terminal lug h, the terminal locking device b must first be disconnected from the connector housing a. Not only is this troublesome but also it takes time and has a possibility of the removed terminal locking device b being lost.

SUMMARY OF THE INVENTION

This invention has focused attention on the above problem and provides a connector with a terminal locking device which enables the terminal lug to be removed from the connector without having to dismounting the terminal locking device from the connector housing.

To achieve the above objective, a connector with a terminal locking device according to this invention comprises: a connector housing having a terminal accommodating chamber block made up of a plurality of terminal accommodating chambers, said terminal accommodating chambers being separated from each other by walls and opening in directions that cross the axial direction of the block, said terminal accommodating chamber block having tapered projections formed on the outer surfaces of the walls; and a terminal locking device fitted over the terminal accommodating chamber block, said terminal locking device being adapted to be connected to the connector housing in two states, first in a preliminary-connection state and then in a full-connection state, said terminal locking device having resilient deflecting plates adapted to be moved along the outer surfaces of the walls of the terminal accommodating chamber block, said resilient deflecting plates having on the inner side thereof terminal locking projections that protrude into the terminal accommodating chambers; whereby when the terminal locking device is connected to the connector housing in the preliminary-connection state, the resilient deflecting plates ride on the tapered projections on the terminal accommodating chamber block, holding the terminal locking projections out of a terminal lug insertion path in the terminal accommodating chambers.

DETAILED DESCRIPTION OF PREFERRED EMBODIMENT

Figure 1:
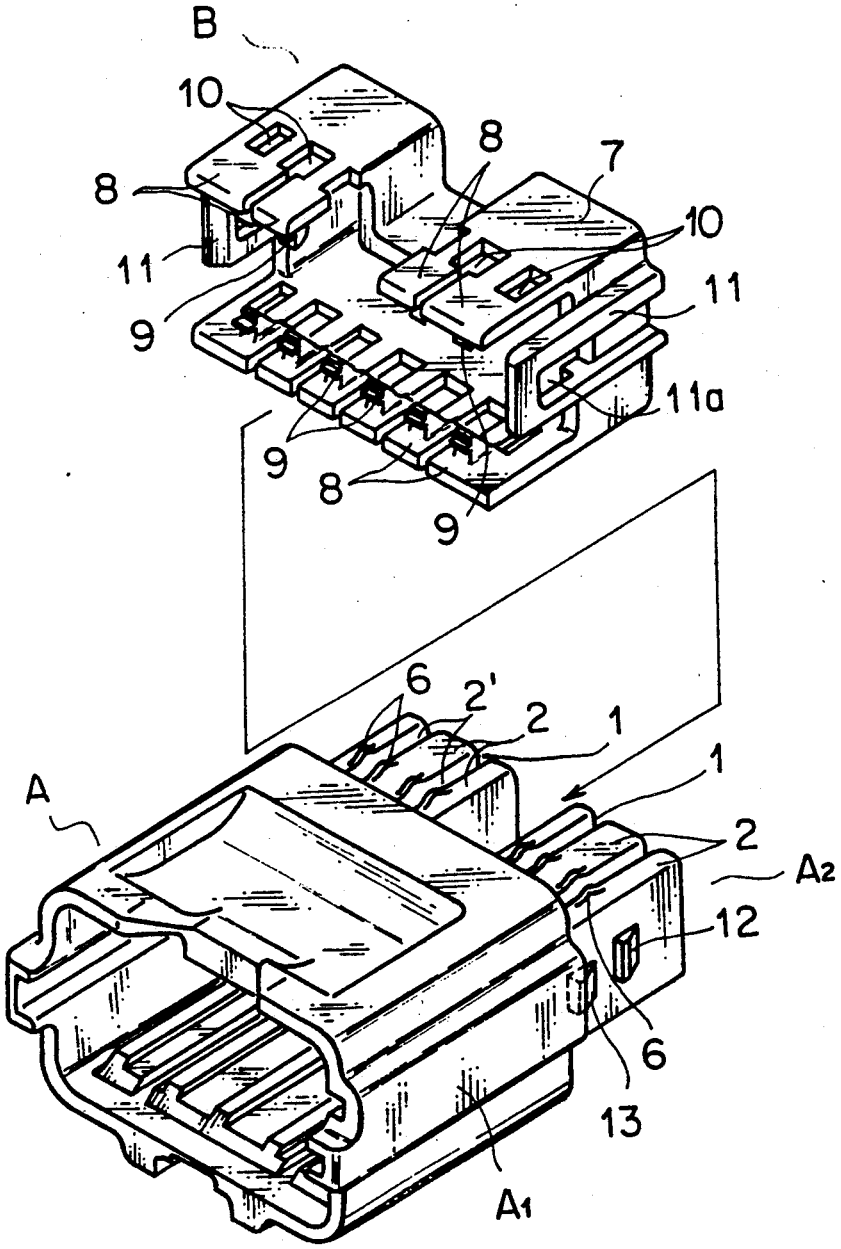
FIG. 1 is a disassembled perspective view of a connector housing and a terminal locking as one embodiment.

Referring to FIGS. 1 to 6, designated A is a connector housing and B a terminal locking device, both formed of synthetic resin.

The connector housing A consists of a case portion $A_1$ formed at the front half and a terminal accommodating chamber block $A_2$ at the rear half, the rear block having no enclosing cover wall.

Each terminal accommodating chamber 1 has wall plates 2, 2 on each side and, between the wall plates 2, opens toward the rear as well as in upward and downward directions that cross the axial direction. The terminal accommodating chamber 1 has a resilient locking piece 3 for a terminal lug C and also a forwardly extending terminal insertion opening 5 in an intermediate wall 4.

The wall plates 2 have longitudinally tapered projections 6 at the outer surfaces, the projections being laterally aligned with each other.

The terminal locking device B consists of a main frame portion 7 that receives the terminal accommodating chamber block $A_2$. The main frame portion 7 has at its top and bottom a plurality of resilient cantilever deflecting plates 8 which correspond to respective terminal accommodating chambers I. Each of the resilient deflecting plates 8 is formed at its inner surface with a terminal locking projection 9. The main frame portion 7 also has escape notches 10 formed at the rear part of the terminal locking projections 9. As the terminal locking device B is mounted to the connector housing A, the resilient deflecting plates 8 slide on the wall plates 2—which define the terminal accommodating chambers 1—and the terminal locking projections 9 protrude into the terminal accommodating chambers 1.

The main frame portion 7 of the terminal locking device B has at both sides forwardly projecting housing engagement arms 11 with an engagement hole 11*a*. The outermost wall plates 2 of the connector housing A have at their outer surfaces a preliminary-engagement projection 12 and a full-engagement projection 13, longitudinally aligned from the rear toward the front, which cooperate with the housing engagement arms 11.

Figure 2:
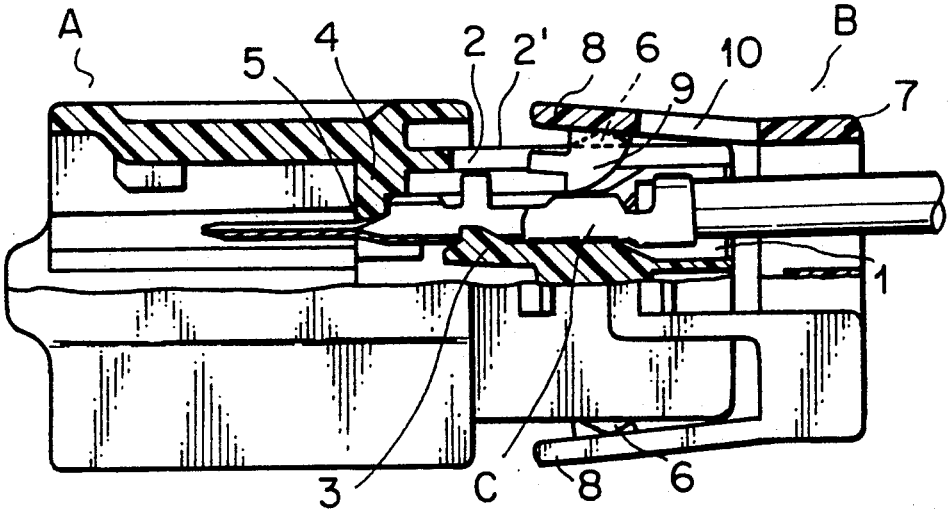
FIG. 2 is a cross section of the embodiment in a preliminary-connection state.

FIG. 2 is a cross section showing the preliminary-connection state in which the housing engagement arm 11 of the terminal locking device B engages with a preliminary-engagement projection 12 of the connector housing A. In this case, the resilient deflecting plate 8 rides on the tapered projection 6, holding the terminal locking projection 9 out of the insertion path of the terminal lug C, so that the terminal lug C can be inserted smoothly until it is engaged with the flexible locking piece 3.

Figure 3:
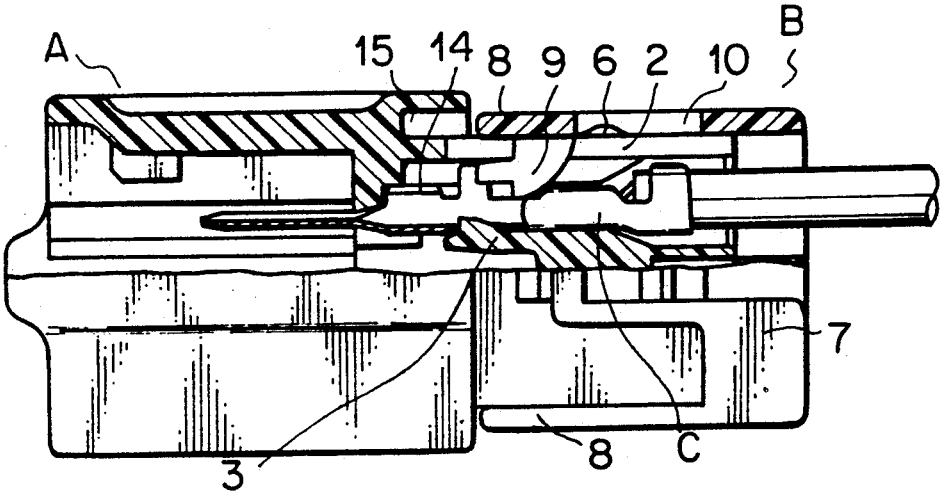
FIG. 3 is a cross section of the embodiment during the process of moving to a full-connection state.
Figure 4:
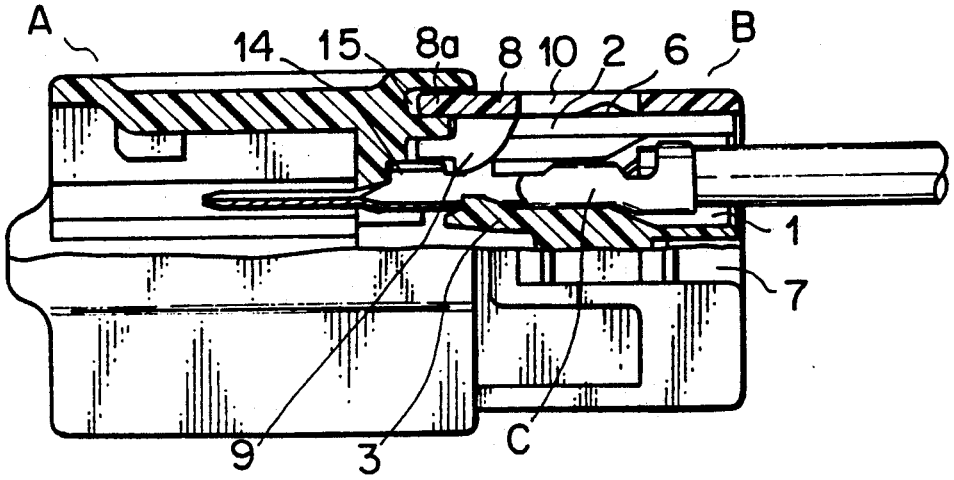
FIG. 4 is a cross section of the embodiment in a full-connection state.

If, in this condition, the terminal locking device B is advanced slightly, the tapered projection 6 is received in the escape notch 10, allowing the resilient deflecting plate 8 to return to its original shape, projecting the terminal locking projection 9 deep into the terminal accommodating chamber 1 (FIG. 3). When the terminal locking device B is further advanced, the housing engagement arm 11 engages with the full-engagement projection 13 effecting the full-connection state, in which the terminal locking projection 9 is located immediately behind the intermediate portion of the terminal lug C, thus locking the terminal lug C doubly, i.e., with the resilient locking piece 3 and with the terminal locking projection 9 (FIG. 4). In the full-connection state, the end portion 8*a* of the resilient deflecting plate 8 is engaged in a recessed portion 15 of the connector housing A, preventing the resilient deflecting plate 8 from moving inadvertently.

Figure 5:
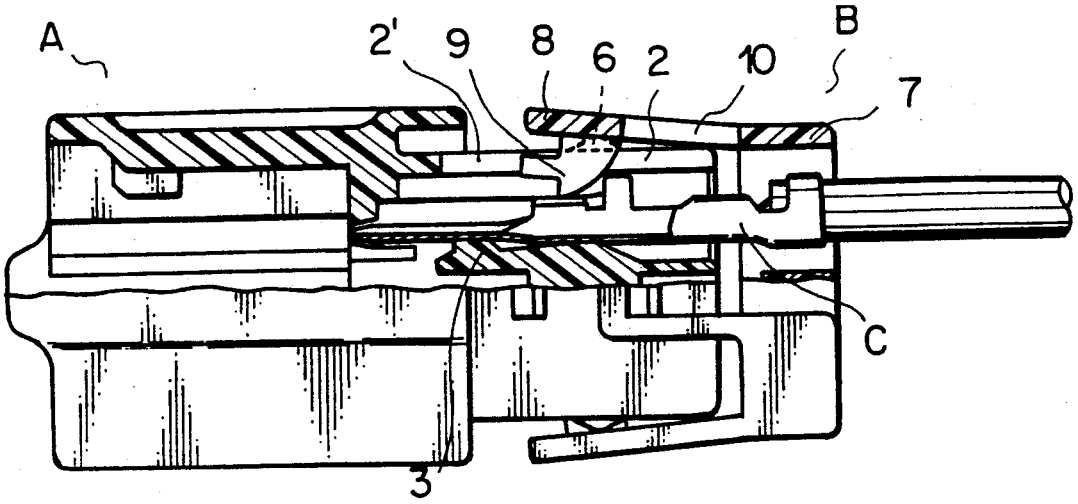
FIG. 5 is a cross section showing the embodiment in the preliminary-connection state with the terminal lug incompletely inserted.
Figure 6:
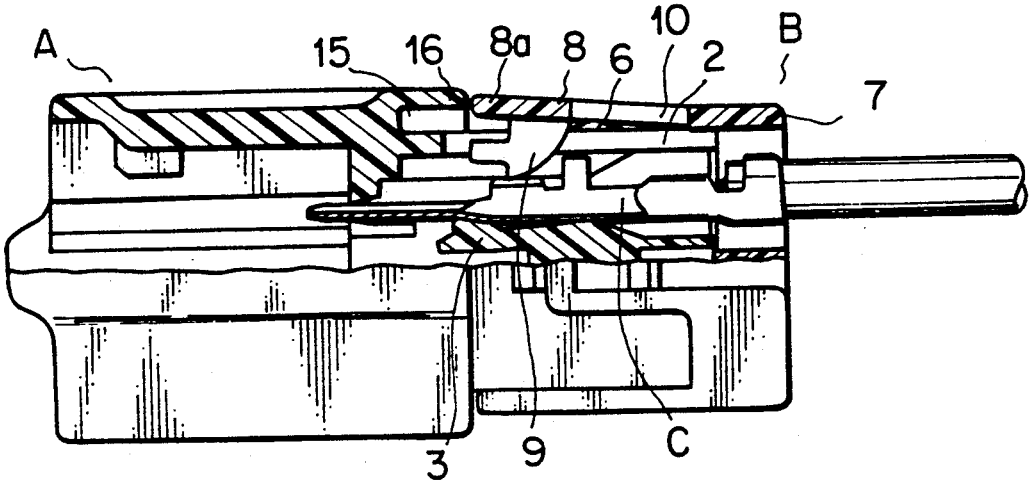
FIG. 6 is a cross section showing the terminal lug being moved from the state of FIG. 5 to the full-connection state.
Figure 7:
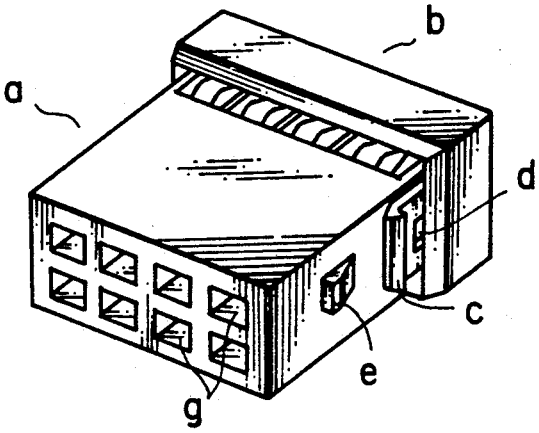
FIG. 7 PRIOR ART
FIG. 7 is a perspective view of a conventional connector housing with a terminal locking device.
Figure 8:
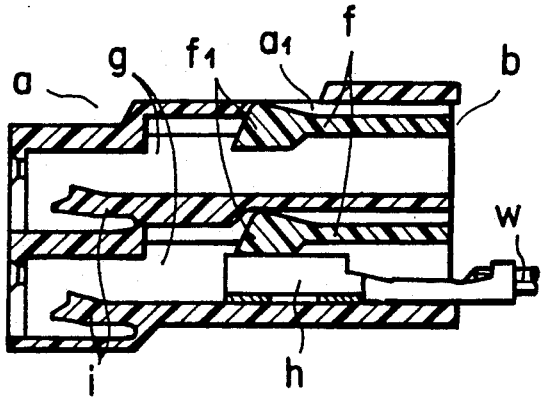
FIG. 8 PRIOR ART
FIG. 8 is a cross section showing the preliminary-connection state of FIG. 7.
Figure 9:
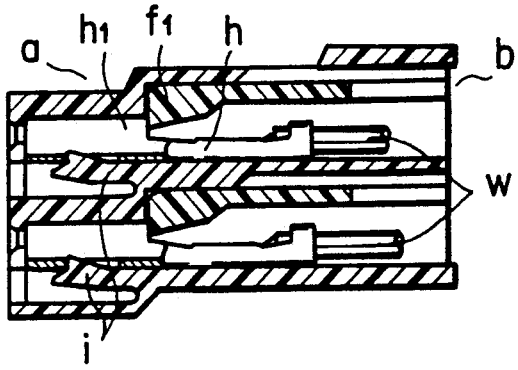
FIG. 9 PRIOR ART
FIG. 9 is a cross section showing the full-connection state of FIG. 7.
Figure 10:
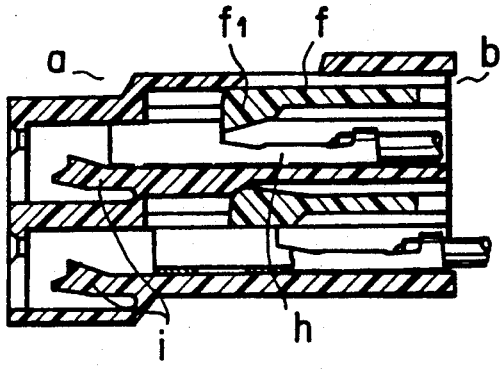
FIG. 10 PRIOR ART
FIG. 10 is a cross section showing the terminal lug moving toward the full-connection state.

FIG. 5 shows the terminal lug C incompletely inserted with the terminal locking device B in a preliminary-engagement position. In this condition, when the terminal locking device B is moved toward the full-connection state, the terminal locking projection 9 rides on the intermediate portion 14 of the terminal lug C, causing the end portion 8*a* of the resilient deflecting plate 8 to abut against the rear portion 16 of the connector housing A, making further advance of the terminal locking device B impossible. This alerts an operator to the incomplete insertion of the terminal (FIG. 6).

In summary the connector of this invention has the following construction and advantage. The connector consists of a connector housing and a terminal locking device. The connector housing has a terminal accommodating chamber block made up of a plurality of terminal accommodating chambers that are separated from each other by walls and that open in directions crossing the axial direction of the block. The terminal locking device is fitted over the terminal accommodating chamber block and is advanced in two steps, first into a preliminary-engagement state and then into a full-engagement state with respect to the connector housing. The terminal locking device is moved along the outer surfaces of the walls of the terminal accommodating chamber block. The terminal locking device has resilient deflecting plates which have terminal locking projections formed on the inner side that protrude through the openings into the terminal accommodating chambers. In the preliminary-engagement state, the resilient deflecting plates ride on tapered projections formed on the outer wall surfaces of the terminal accommodating chamber block, holding the terminal locking projections out of a terminal lug insertion path in the terminal accommodating chambers. This allows the terminal lug to be pulled out easily from the connector.

What is claimed is:

1. A connector with a terminal locking device comprising:

a connector housing having a terminal accommodating chamber block made up of a plurality of terminal accommodating chambers, said terminal accommodating chambers being separated from each other by walls and opening in directions that cross the axial direction of the block, said terminal accommodating chamber block having tapered projections formed on the outer surfaces of the walls; and a terminal locking device fitted over the terminal accommodating chamber block, said terminal locking device being adapted to be connected to the connector housing in two states, first in a preliminary-connection state and then in a full-connection state, said terminal locking device having resilient deflecting plates adapted to be moved along the outer surfaces of the walls of the terminal accommodating chamber block, said resilient deflecting plates having on the inner side thereof terminal locking projections that protrude into the terminal accommodating chambers;

whereby when the terminal locking device is connected to the connector housing in the preliminary-connection state, the resilient deflecting plates ride on the tapered projections on the terminal accommodating chamber block, holding the terminal locking projections out of a terminal lug insertion path in the terminal accommodating chambers.

* * * * *